US009102500B2

(12) United States Patent
Barea

(10) Patent No.: US 9,102,500 B2
(45) Date of Patent: Aug. 11, 2015

(54) YARN FEED-SEPARATION DEVICE

(75) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 166 days.

(21) Appl. No.: 13/877,445

(22) PCT Filed: Oct. 19, 2011

(86) PCT No.: PCT/EP2011/005262

§ 371 (c)(1),
(2), (4) Date: Apr. 2, 2013

(87) PCT Pub. No.: WO2012/052166

PCT Pub. Date: Apr. 26, 2012

(65) Prior Publication Data

US 2013/0193251 A1 Aug. 1, 2013

(30) Foreign Application Priority Data

Oct. 22, 2010 (IT) ..... MI2010A1937

(51) Int. Cl.
*B65H 51/24* (2006.01)
*B65H 51/22* (2006.01)
*D03D 47/36* (2006.01)

(52) U.S. Cl.
CPC ..... *B65H 51/22* (2013.01); *D03D 47/361* (2013.01)

(58) Field of Classification Search
CPC ..... B65H 51/22; B65H 51/24; B65H 51/26; D03D 47/361
USPC ..... 242/364.9–365.2, 366.3
See application file for complete search history.

(56) References Cited

U.S. PATENT DOCUMENTS 2,255,017 A * 9/1941 Torrence et al. ..... 242/366.2
2,303,052 A 11/1942 Kline, et al.
2,431,712 A 12/1947 Stanley (Continued)

FOREIGN PATENT DOCUMENTS

CN 88102126 A 10/1988
CN 101506421 A 8/2009

(Continued)

OTHER PUBLICATIONS

Search Report dated Jan. 27, 2014 from Chinese application 201180051024.4, filed Oct. 19, 2011.

(Continued)

*Primary Examiner* — William E Dondero
(74) *Attorney, Agent, or Firm* — Novak Druce Connolly Bove + Quigg LLP

(57) ABSTRACT

A device to enable yarn to be fed for textile applications and the relative turns to be separated. The device includes a wheel/drum directly or indirectly motorized for rotation about its axis, the wheel/drum presenting in its lateral surface a series of slits to receive relative blades the projecting profile of which enables the yarn turns wound on the wheel/drum to advance. The blades form an assembly which rotates together with the wheel/drum but about an axis having an inclination and/or an eccentricity relative to the axis of the wheel/drum, such that the profile projection of the blades from the relative slits varies gradually along the perimeter of the wheel/drum, from a minimum to a maximum, to then return to a minimum, but remains constant with time. The blades have a length to be able to receive all the yarn turns which concern the device.

10 Claims, 2 Drawing Sheets

(56) References Cited

U.S. PATENT DOCUMENTS

| | | | | | |
|---|---|---|---|---|---|
| 3,709,444 | A | | 1/1973 | Tannert | |
| 3,796,386 | A | * | 3/1974 | Tannert | 242/364.7 |
| 3,971,522 | A | | 7/1976 | Pfarrwaller | |
| 4,037,802 | A | * | 7/1977 | Calamani et al. | 242/364.7 |
| 4,180,215 | A | * | 12/1979 | Nurk | 242/364.5 |
| 4,403,745 | A | | 9/1983 | Tholander | |
| 4,828,192 | A | | 5/1989 | Sarfati | |
| 5,310,127 | A | | 5/1994 | Deiuri | |
| 5,890,670 | A | | 4/1999 | Zenoni et al. | |
| 7,086,624 | B2 | * | 8/2006 | Zaglio | 242/364.8 |

FOREIGN PATENT DOCUMENTS

| | | | |
|---|---|---|---|
| EP | 1512781 | A2 | 3/2005 |
| FR | 1001138 | A | 2/1952 |
| JP | 47-038908 | A | 10/1974 |
| JP | 50-059565 | A | 5/1975 |
| JP | 04-222250 | A | 8/1992 |
| WO | 2008017319 | A1 | 2/2008 |

OTHER PUBLICATIONS

International Search Report dated Jan. 25, 2012 for PCT/EP2011/005262 to Barea, filed Oct. 19, 2011.

May 20, 2014, Official Action issued in corresponding Japanese Patent Application No. 2013-534195.

Aug. 19, 2014, Official Action issued in corresponding European Patent Application No. 11772899.8.

* cited by examiner

YARN FEED-SEPARATION DEVICE

CROSS-REFERENCE TO RELATED APPLICATIONS

This is a §371 National Stage Application of International Application No. PCT/EP2011/005262 filed on 19 Oct. 2011, claiming the priority of Italian Patent Application No. MI2010A001937 filed on 22 Oct. 2010.

The present invention relates to yarn feeders for textile applications and in particular to a device which enables both the yarn to be fed and its turns to be separated.

Various types of yarn feeder are known in the art for textile applications. All known feeders present a wheel, or cylinder, about which the yarn is wound in the form of one or more turns. It is therefore of fundamental importance to prevent these turns from being able to overlap each other and hence to to "pinch" during feed. This can in fact cause yarn breakage or a defect in the finished product.

These wheel yarn feeders are therefore either provided with means to prevent the turns wound on the wheel from overlapping each other, or the wheel itself is made to perform this function.

Said wheel can be a rotating member (rotated by a motor), or a fixed member onto which an external member (also operated by a motor) loads the yarn, depending on the method of operation of the feeder.

Motorized wheel feeders with a fixed separator device are already known. Specifically, this latter is a fixed bar disposed in the vicinity of the wheel and lying in the same plane as the axis of this latter, but inclined to this axis (in the most advanced versions this inclination is adjustable). The yarn, originating from a bobbin, is wound through one or more turns onto the wheel-bar assembly without straddling occurring, precisely because of the bar inclination.

Motorized wheel feeders are also known in which overlapping of the yarn turns is prevented by slightly inclining the wheel rotation axis to the horizontal. In this manner the point at which the yarn enters the wheel and the point at which it leaves it are in two different parallel vertical planes, so that the turns on the wheel do not overlap each other because they lie side by side, even if not separated.

In another known solution, a projecting ring, lying in a plane slightly inclined to a plane perpendicular to the wheel axis, is fixed to the peripheral surface of a motorized wheel/drum, so that on rotating the drum and consequently said ring, this latter causes the yarn forming the first turn (that closest to the yarn entry point) to be withdrawn by the inclined ring, while simultaneously urging the other turns already present on the drum to hence cause them to slide, side by side and mutually compacted, along the drum to the exit point. In a further known solution, a fixed drum has in its cylindrical surface a series of preferably angularly equidistant slits in which respective blades are disposed to rock in cyclic succession such as to project from the relative slit and consequently cause the yarn turns to advance towards the exit point. The cyclic blade rocking movement is independent of the unwinding of the yarn and is caused by an external motor member, generally the same used to operate the yarn turn loading member. This latter deposits the yarn onto the fixed drum, the rocking movement of the blades causing the turns to advance and be maintained separated from each other.

In their essential characteristics the aforedescribed solutions present various drawbacks, which are analyzed case by case below.

Although the solution comprising the motorized wheel with fixed bar separator has the advantage of achieving effective adjustable separation of the turns on the wheel, it has the drawback of generating friction due to the rubbing of the yarn on the fixed bar, which in fact limits the maximum number of turns which can be wound on the wheel, in addition to causing damage to the yarn, which is subjected to continuous mechanical stress. This friction also limits the minimum tension at which the device can operate and increases the energy consumption required to ensure wheel rotation. Finally, the greater the working tension and the number of turns, the greater is the power required at the motor.

In the case of the inclined motorized wheel solution, there is the drawback of not achieving proper separation (as stated, the turns are in mutual contact). Essentially, the small "transfer" surface between the wheel and yarn is utilized to enable the turns sliding on the wheel to advance, i.e. the yarn does not make contact with the wheel over its entire circumference, but touches it only at certain points because of projecting ribs (also called spokes in technical jargon) parallel to the wheel rotation axis. The result is that the first turn urges the subsequent turns, so compacting them. This type of feeder is also generally provided on purpose with a fixed bar separator to be used with certain yarn types.

The motorized wheel with inclined ring solution also does not enable true separation to be achieved (as stated, again in this case the turns are in mutual contact) and hence has the same limits as the inclined motorized wheel solution, limits which become particularly significant with certain yarn types (for example elastic yarn), because of friction. A further drawback of this solution is that in unwinding from the bobbin via the feeder, the yarn undergoes twisting (this twist being added to or subtracted from the natural yarn twist) which can cause problems during production, representing in fact an alteration in the intrinsic characteristics of the yarn.

Although the solution comprising the fixed drum with cyclically rocking blades has the advantage of providing true mutual separation between the yarn turns, it also has the drawback of subjecting the yarn withdrawn from the bobbin to twisting (this twist being again added to or subtracted from the natural yarn twist). Another drawback is that this solution does not operate with certain yarn types (in particular elastic yarns) because as the drum is fixed, the rocking blades are unable to advance the yarn on the drum because of the friction between yarn and drum.

U.S. Pat. No. 3,971,522 enables certain of the aforedescribed drawbacks to be overcome. Specifically, a solution is described (see the embodiment of FIG. 3) comprising a motorized wheel/drum rotating about its axis and presenting a series of angularly equidistant slits to receive corresponding teeth of a wheel rotatable about an axis which is inclined to and eccentric to the axis of rotation of the wheel/drum. Consequently these teeth, or blades, project differently from the corresponding slits, this projection varying gradually in moving along the wheel/drum perimeter from a minimum to a maximum, to then return to a minimum, but which remains constant with time. These blades have a profile, in the direction of the relative wheel axis, which enables the lastly formed yarn turn to be separated from the previously formed turn, while at the same time advancing the turns, so that they pass from the blades to the wheel/drum, on which however they accumulate by coming into mutual contact (as shown by said FIG. 6 of U.S. Pat. No. 3,971,522), to give rise to the already described drawback.

U.S. Pat. No. 2,431,712 also enables certain of the aforedescribed drawbacks to be overcome, by providing a rotatable wheel/drum with blades received in relative slits, but rocking such that the projection of the individual blade varies cyclically with time. Again in this case the yarn turns pass from the blades to the wheel/drum, to accumulate and come into mutual contact.

An object of the present invention is therefore to provide a yarn feeder-separator device which does not present the aforedescribed drawbacks.

This object is attained by the yarn feeder-separator device in accordance with the accompanying claims.

The invention will be more apparent from the ensuing description of one exemplifying embodiment thereof. In this description reference is made to the accompanying drawings, in which.

As can be seen from the figures, the device 10 for feeding/distributing yarn for textile applications comprises a wheel/drum 12 fixed in conventional manner to a motorized shaft 14 the axis of which coincides with the axis 16 of the wheel/drum 12, so that this latter rotates rigidly with the shaft 14 when the relative motor is operated.

Figure 4:
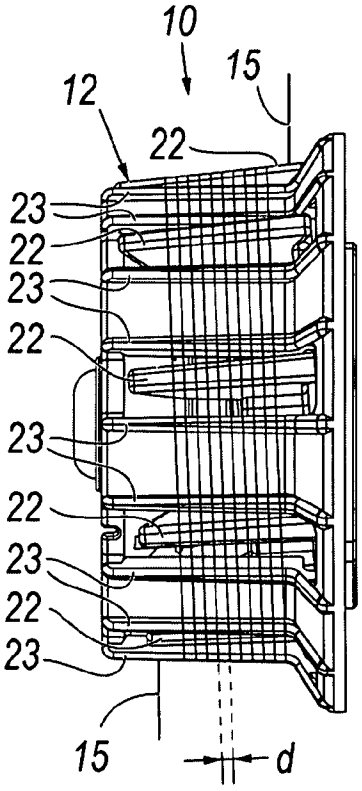
FIG. 4 is a view equal to that of FIG. 1, but with the yarn wound in is separated turns.

The lateral surface of the wheel/drum 12, about which the yarn 15 (FIG. 4) is wound into turns, is of overall cylindrical shape with a flared edge 18 on the side on which the shaft 14 is located, and presents a series of angularly equidistant slits 20 (nine in number in the illustrated example). Each slit 20 receives a relative blade 22. The assembly of blades 22 rotates, by entrainment, together with the wheel/drum 12 when this latter is rotated. From the figures, it can also be seen that the radial projection of the individual blades 22 from the relative slit 20 gradually varies along the perimeter of the wheel/drum 12, to pass from a maximum projection of the upper blade 22 to zero projection of the lower blade 22, and to return to maximum projection of the upper blade. It is important to note that the projection of each blade 22 does not vary with time, so that it is not influenced by the rotation of the wheel/drum 12. This is because the blades 22 are fixed to an annular element 24 having an axis 26 inclined by an angle $\alpha$ to the axis 16 of the wheel/drum 12. The annular element 24 is itself fixed coaxially to a bearing 28 carried by the shaft 14 such that it is able to rotate freely about this shaft, but also with the required inclination $\alpha$. It should be noted that the relative rotation between the bearing 28 and shaft 14 is limited to the clearances existing between the blades 22 and the relative slits 20 (i.e. extremely limited), such that just a suitable bronze bush or a suitable ring of low friction coefficient material (e.g. TEFLON) can be used, however a suitably shaped rolling bearing can be used if required.

Figure 2:
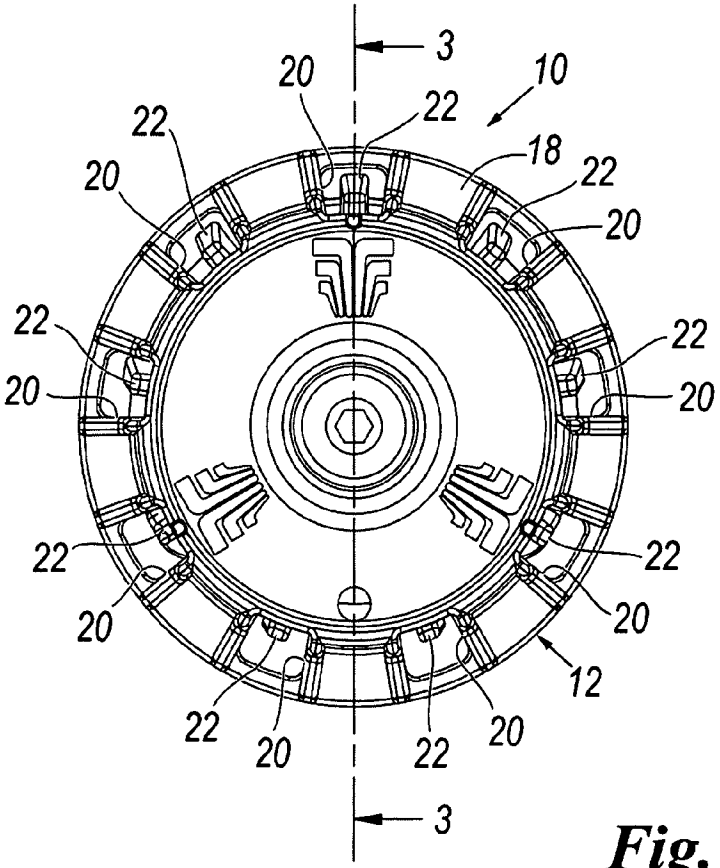
FIG. 2 is a front view in the direction of the arrow 2 of FIG. 1.
Figure 1:
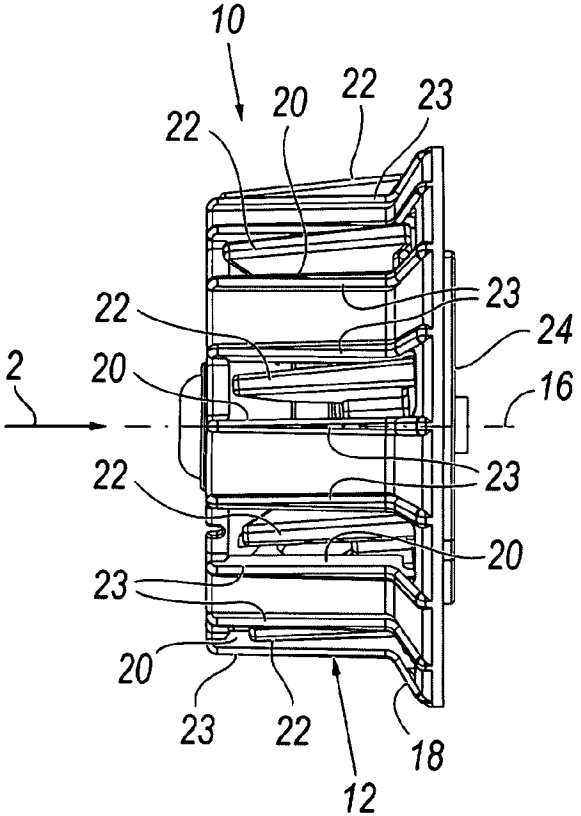
FIG. 1 is a side elevation of a device according to the present invention.
Figure 3:
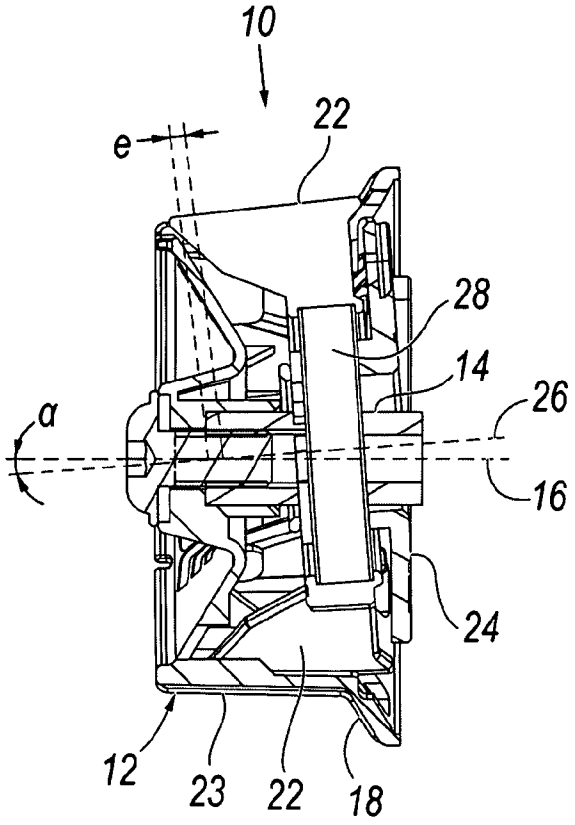
FIG. 3 is a section therethrough on the line 3-3 of FIG. 2.

From FIGS. 1 and 3 it can be seen that the blades 22 have an external profile slightly inclined to the axis 16 to facilitate advancement of the yarn turns on the wheel/drum 12.

It should be noted that instead of inclining the axis 26 of the blade 22 assembly to the axis 16, the same result can be achieved simply by not making the axis 26 of the blade 22 assembly intersect the axis 16 of the wheel/drum 12 (so that in this case there is a minimum distance, or eccentricity, between the two, to be indicated by "e"), or again by inclining said two axes and also providing said eccentricity between them. Although such an eccentricity e, even if present, could not in reality be seen on observing the figures, it has been indicated for representative purposes in FIG. 3.

As is apparent to an expert in mechanics, means (not shown for simplicity) could be provided to adjust the angle $\alpha$ and/or the eccentricity e (for example a screw regulator means or a mechanical actuator), with the advantage of being able to adjust the extent of separation between the yarn turns.

It should also be noted that the drive shaft can be made coaxial to the axis of the blade 22 assembly, and the wheel/drum 12 be rotatably driven about an axis 16 eccentric to and/or inclined to the axis 26.

To reduce the friction between the yarn 15 and the external surface of the wheel/drum 12 as much as possible in order to facilitate yarn advancement during separation, this surface can be provided parallel to the axis 16 with projecting ribs 23 (spokes) on which just the yarn rests (evidently in addition to resting on the blades 22).

From tests carried out, it has been found that the number of blades and the ratio between the wheel/drum surface area in contact with the yarn and the blade surface area in contact with the yarn are a function of the minimum value of the separation distance d to be guaranteed between the turns.

The tests have also shown that the value of the two parameters, eccentricity e and inclination $\alpha$, are fundamentally important for correct separation of the yarn turns. In particular, the eccentricity e is a function of the diameter of the wheel/drum 12 while the inclination $\alpha$ decides the distance (d) by which the turns must be separated from each other. For example, for a wheel/drum with a diameter between 30 and 60 mm it has been found that to ensure good separation the eccentricity e must be between 0 and 10 mm and the inclination $\alpha$ between 0° and 30°, it being understood that they cannot be null simultaneously.

It should also be noted that rotary motion transmission from the wheel/drum 12 to the blade 22 assembly (or vice versa) can be achieved not only by direct contact between blades and relative sides of the slits 20 (as in the embodiment illustrated in the figures, possibly by interposing elements of a material having vibration damping properties, such as silicone rubber or neoprene sponge elements) but also by magnetic coupling.

It is important to note that the feeder-separator device according to the present invention enables effective separation d to be obtained, and maintained, of all those yarn turns concerning the device 10 (this separation, as aforestated, even being adjustable), in addition to reducing the unwinding tension of the yarn 15 to a minimum and enabling even a large number of turns to be obtained on the device 10, provided the blades 22 are of sufficient length to receive all the turns wound onto the device 10 (in any event a number of turns greater than that obtainable with known devices), hence preventing slippage of the yarn 15.

It should further be noted that the number of turns does not affect the rotation force of the wheel/drum 12, precisely because the wheel/drum is not fixed but rotates together with the blades 22, and that the yarn 15 does not undergo any twisting (as it enters or exits). The yarn turn separation action is synchronized with the wheel/drum rotation and hence with the yarn feed.

Finally it is important to note that by virtue of the wheel/drum rotation, the device of the invention operates without problems using any yarn type (in particular elastic yarns), as it is not influenced by friction.

The invention claimed is:

1. A device for feeding yarn for textile applications, and for separating the relative turns, comprising:

a wheel/drum directly or indirectly motorized for rotation about an axis of the wheel/drum, the wheel/drum presenting in a lateral surface of the wheel/drum a series of slits to receive relative blades a projecting profile of the blades enables the yarn turns wound on the wheel/drum to advance, the blades forming an assembly which rotates together with the wheel/drum but about an axis of the blade having an inclination angle ($\alpha$) and/or an eccentricity (e) relative to the axis of the wheel/drum, such that the profile projection of the blades from the relative slits varies gradually along the perimeter of the wheel/drum, from a minimum to a maximum, to then gradually return to a minimum, but remains constant with time for simultaneously rotating the wheel\drum about the wheel\drum axis and rotating the blades about the axis of the blade, the blades having a length to receive all the yarn turns which concern the device, means for adjusting inclination of the axis of the blade assembly to the axis of the wheel/drum; and/or for adjusting the eccentricity of the axis of the blade to the axis of the wheel/drum, to consequently adjust the extent of separation between the yarn turns wound on the wheel/drum.

2. A device as claimed in claim 1, wherein the wheel/drum is coaxially fixed to a drive shaft, the blade assembly being entrained by the wheel/drum.

3. A device as claimed in claim 2, wherein the blade assembly is coaxially fixed to an annular element the axis of the annular element intersects the axis of the wheel/drum to form an angle of inclination to the axis of the drive shaft to which the wheel/drum is fixed, the annular element being fixed coaxially to a bearing rotatably carried by the drive shaft such that the annular element is able to rotate about said shaft but with the required angle of inclination.

4. A device as claimed in claim 3, wherein the bearing is of a material of low friction coefficient.

5. A device as claimed in claim 2, wherein the entrainment takes place by interference between the blades and a relative edge of the slits involved in the entrainment, an element of a material with vibration damping properties being interposed between each blade and the edge of the relative slit.

6. A device as claimed in claim 2, wherein the entrainment of the blade assembly by the wheel/drum takes place by magnetic coupling.

7. A device as claimed in claim 1, wherein the blade assembly is coaxially fixed to a drive shaft, the wheel/drum being rotatably entrained by the blade assembly.

8. A device as claimed in claim 1, wherein the lateral surface of the wheel/drum presents projecting ribs parallel to the axis, the yarn wound in the form of turns resting only on said ribs, in addition to resting on the blades.

9. A device as claimed in claim 1, wherein the wheel/drum has a diameter between 30 mm and 60 mm, the eccentricity is between 0 mm and 10 mm and the inclination is between 0° and 30°, but the eccentricity and inclination cannot be null simultaneously.

10. A device as claimed in claim 1, wherein the assembly comprises the blades fixed to an annular element having an axis inclined by the angle (a) and/or eccentricity (e) to the axis of the wheel/drum, wherein the annular element is fixed coaxially to a bearing carried by a drive shaft such that the annular element is freely rotatable about this drive shaft.

* * * * *